US005382502A

United States Patent [19]

Lau et al.

[11] Patent Number: 5,382,502

[45] Date of Patent: Jan. 17, 1995

[54] HYDROXYQUINOLINE CYAN COUPLERS AND THEIR PROCESS OF PRODUCTION

[75] Inventors: Philip T. S. Lau; Danny R. Thompson; Stanley W. Cowan, all of Rochester, N.Y.

[73] Assignee: Eastman Kodak Company, Rochester, N.Y.

[21] Appl. No.: 97,315

[22] Filed: Jul. 23, 1993

Related U.S. Application Data

[63] Continuation of Ser. No. 809,951, Dec. 18, 1991, abandoned.

[51] Int. Cl.[6] ..... G03C 7/34

[52] U.S. Cl. ..... 430/552; 430/553; 430/558

[58] Field of Search ..... 430/552, 553, 558

[56] References Cited

FOREIGN PATENT DOCUMENTS 3073949 4/1991 Japan ..... 430/553

*Primary Examiner*—Lee C. Wright
*Attorney, Agent, or Firm*—Arthur E. Kluegel

[57] ABSTRACT

8-hydroxyquinoline and 5-hydroxyquinoline compounds of the following formulae:

or

, wherein:

$R_1$ is a substituted or unsubstituted alkyl group with 8 to 30 carbon atoms;

$R_2$ is hydrogen or another substituent;

X is a group capable of being released by a coupling reaction with an oxidized aromatic primary amine developing agent; and Z is a nonnucleophilic substituent or a group not capable of being eliminated during or following a coupling reaction with an oxidized color developer have been found to be useful in photographic materials as cyan dye-forming couplers. A process in which a substituted aminophenol salt reacts with two molar equivalents of an enolizable aldehyde containing at least two a-substituted hydrogen atoms is used to make these couplers and other hydroxyquinoline compounds.

12 Claims, No Drawings

HYDROXYQUINOLINE CYAN COUPLERS AND THEIR PROCESS OF PRODUCTION

This application is a continuation of application Ser. No. 07/809,951, filed Dec. 18, 1991, now abandoned.

FIELD OF THE INVENTION

The present invention relates to photographic materials containing 8-hydroxyquinoline and 5-hydroxyquinoline cyan dye-forming couplers and a process of making these couplers.

BACKGROUND OF THE INVENTION

A dye imaging in a silver halide-containing photographic material is formed by reacting an exposed silver halide with a color developer, generally a p-phenylenediamine compound. An oxidized form of the developer is produced which then reacts with a compound called a coupler to yield a dye. Full color reproduction of an image is generally achieved through a subtractive color process, in which the primary colors red, green and blue are reproduced by forming dyes of their complementary colors—i.e. cyan, magenta, and yellow, respectively. The subtractive color process is described in T. H. James, ed., *The Theory of the Photographic Process,* Fourth Edition, Macmillan, New York, 1977, pp. 336 ff.

For the formation of cyan dye images, the most commonly used couplers are variously substituted phenols and naphthols. A substituent of the coupler, called a coupling off group, is located at the position of reaction between the oxidized developer and the phenol or naphthol and is eliminated in the process of dye formation. In most color photographic materials, the coupler is incorporated in a layer containing silver halide and is immobilized in that layer by a high molecular weight ballast substituent on the coupler. Cyan couplers are discussed in *The Theory of the Photographic Process,* pp. 358 ff.

Various hydroxyquinoline compounds have been described as couplers in color photographic materials. U.S. Pat. Nos. 2,449,966, 2,455,169, and 2,584,349 disclose 8-hydroxyquinolines with arylazo coupling off groups, which can be used as masking couplers for color correction. U.S. Pat. No. 2,524,725 and 2,524,741 relate to 8-hydroxyquinoline couplers that react with o-phenylenediamine developers to form intermediate compounds that can be cyclized to form magenta-colored phenazonium dyes. The couplers disclosed in U.S. Pat. No. 2,886,436 are derivatives of 6-amino-8-hydroxyquinoline that undergo cyclization after reaction with oxidized p-phenylenediamine developer to product magenta-colored azine dyes.

U.S. Pat. No. 4,296,199 and 4,296,200 disclose a larger number of different types of cyan couplers with thiosubstituted alkoxy coupling off groups. Included amongst these compounds are hydroxyquinoline cyan couplers, but no specific structures are mentioned.

U.S. Pat. No. 4,770,988 discloses a broad class of cyan couplers used in combination with phenol cyan couplers, while U.S. Pat. No. 4,898,812 relates to the use of a cyan coupler in combination with a development accelerator contained in the same layer. Both U.S. Pat. Nos. 4,770,988 and 4,898,812 disclose one specific 8-hydroxyquinoline, containing a high molecular weight substituted benzamido group in the 7-position and a chloro coupling off group in the 5-position. There is no indication that this compound can be substituted at the 1 or 2 positions with alkyl ballast groups.

One of the most general synthesis of quinoline compounds is the Doebner-von Miller reaction, in which an aromatic amine is condensed with an $\alpha,\beta$-unsaturated carbonyl compound at high temperature in the presence of a strong acid (G. Jones, ed. "Quinolines," Part I, in A. Weissberger and E. C. Taylor, eds., *The Chemistry of Heterocyclic Compounds,* vol. 32, John Wiley & Sons, New York 1977, p. 100) as shown in the following formula:

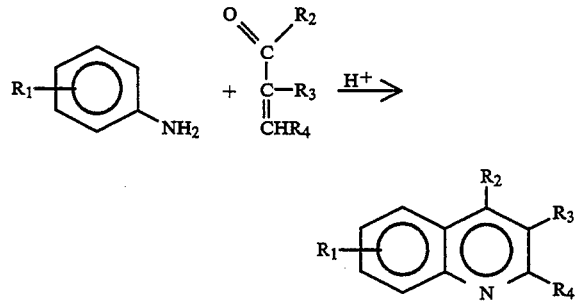

When $R_1$ is —OH, the product is a hydroxyquinoline. Because of the drastic reaction conditions utilized in this process, the yield of desired product is low, and its separation from a mixture of tarry by-products is difficult. Many attempts have been made to improve the yield of quinoline compounds from this synthesis. For example, R. Manske et al., *Can. J. Res.* 27, 1949, p. 359 discloses a Skraup variation of the Doebner-von Miller reaction where a mixture of aminophenols, corresponding nitro compounds, and excess glycerol in concentrated sulfuric acid react and achieve good yields of hydroxyquinoline compounds as follows:

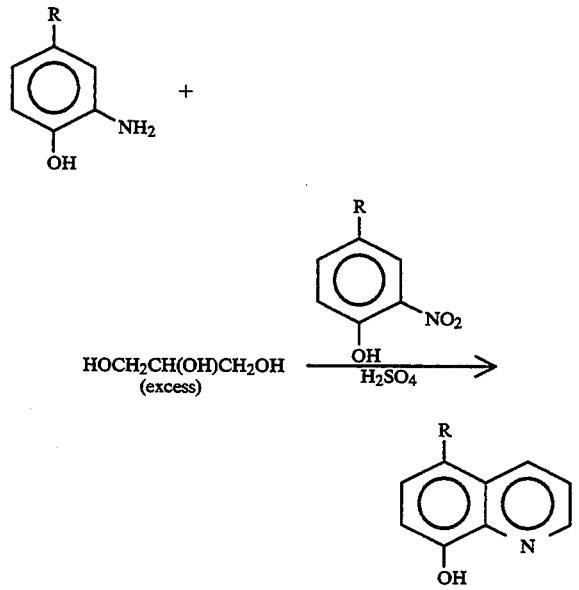

wherein R is H or Cl

Isolation and purification of the products of this reaction, were still tedious, and the use of glycerol precluded introduction of substituents into the heterocyclic nucleus.

Another approach to improving the synthesis of hydroxyquinoline utilized derivatives of the starting $\alpha,\beta$- unsaturated carbonyl compounds. For example, in Y. Oi, E. Omori, Jap. Pat. 70 16948, C.A. 73, 98820 (1970), 2-aminophenols were condensed with the diacetyl derivative of acrolein to yield 8-hydroxyquinolines as follows:

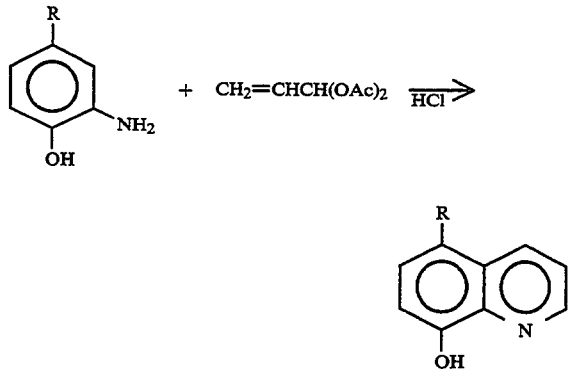

Similarly, in H. J. Teuber, S. Benz, Chem. Ber. 100, 2918 (1967), 3-aminophenols reacted with 3-ethoxyacrolein diethyl acetal to give 5-hydroxyquinoline compounds as follows:

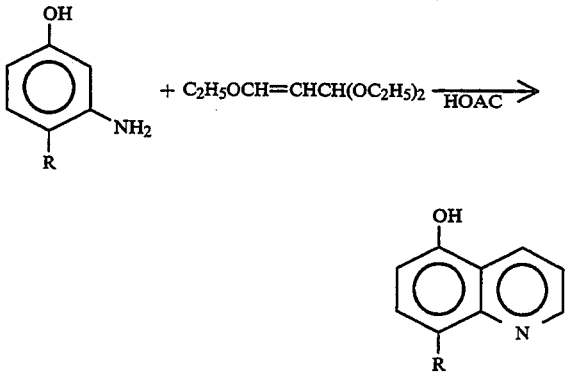

However, as with the previous procedures, these latter two reactions did not allow for the presence of substituents in the heterocyclic ring.

The Doebner-von Miller synthesis and its variants are thus limited to the production of simple quinolines of low molecular weight. Further, the difficulty of preparing complex $\alpha,\beta$-unsaturated carbonyl compounds restricts the introduction of substituents into the heterocyclic nucleus. Finally, the drastic reaction conditions, i.e. strong acid and high temperatures, generally result in low yields of the desired products and difficult isolation of them from a myriad by-products. A need thus exists for a simple synthetic method, carried out under mild conditions, to produce hydroxyquinoline compounds and, particularly, the 8-hydroxyquinoline and 5-hydroxyquinoline cyan couplers of the present invention.

BRIEF SUMMARY OF THE INVENTION

The present invention relates to 8- and 5-hydroxyquinoline cyan dye-forming couplers of the formulae shown below and their uses in color photographic materials:

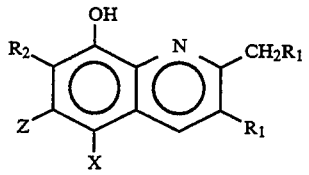

or

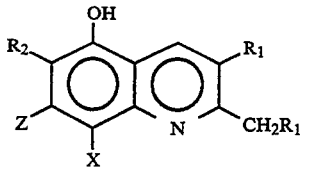

, wherein $R_1$ is a substituted or unsubstituted alkyl group with 8 to 30 carbon atoms;

$R_2$ is hydrogen or another substituent;

X is a coupling off group that is released in a coupling reaction with an oxidized aromatic primary amine color developer; and Z is a non-nucleophilic substituent or group not capable of being eliminated during or following a coupling reaction with an oxidized color developer.

This invention further relates to a process of preparing hydroxyquinoline compounds, including the 8-and 5-hydroxyquinoline cyan couplers of the present invention by reacting substituted aminophenol salt with two molar equivalents of an enolizable aldehyde containing at least one $\alpha$-substituted hydrogen atoms as follows:

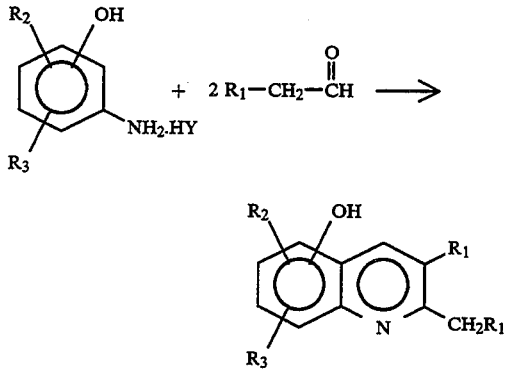

, wherein $R_1$ is a substituted or unsubstituted alkyl group with one to 30 carbon atoms;

$R_2$ and $R_3$ is hydrogen or other substituents; and

HY is a strong organic or inorganic acid

This process is carried out under very mold reaction conditions, at room temperature or below, and in the presence of a solvent, such as methanol or ethanol. The desired hydroxyquinoline compounds generally separate either as salts or as free bases from the reaction mixture and are readily isolated in good yields. An added advantage of this technique is the ability to substitute ballast groups of variable size at the 1 and 2 positions of the hydroxyquinoline compounds. Thus, the process of the present invention is much more convenient and versatile than previously known methods of synthesizing hydroxyquinolines and can be used to prepare not only the 8hydroxyquinoline and 5-hydroxyquinoline cyan couplers of the present invention but also other 6- and 7-hydroxysubstituted quinoline compounds.

DETAILED DESCRIPTION OF THE INVENTION

The present invention relates to 8-hydroxyquinoline and 5-hydroxyquinoline cyan couplers of the following structures:

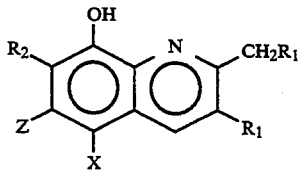

or

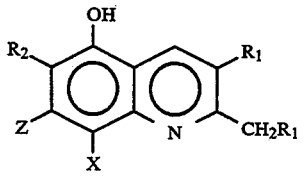

wherein $R_1$ is a substituted or unsubstituted alkyl group with 8 to 30 carbon atoms;

$R_2$ is hydrogen or another substituent;

X is a coupling off group that is released in a coupling reaction with an oxidized aromatic primary amine color developer, preferably a p-phenylenediamine; and Z is a non-nucleophilic substituent not capable of being eliminated during or following a coupling reaction with an oxidized color developer.

The $R_2$ substituents can be, in addition to hydrogen, a halogen, $—OR_3$, cyano, $—NHCOR_3$, $—NHSO_2R_3$, $CONHR_3$, and $—NHCONHR_3$, where $R_3$ is an unsubstituted or further substituted alkyl group or an unsubstituted or substituted aryl group. The Z substituent can be, in addition to hydrogen, $—OR_3$, cyano, $—NHCOR_3$, $CONHR_3$, and $—NHCONHR_3$, where $R_3$ is a substituted or unsubstituted alkyl group or a substituted or unsubstituted aryl group. The coupling off group X can be halogen, alkoxy, aryloxy, arylthio, acyloxy, thiocyano, sulfonamido, and sulfonyloxy, among others, as described in *The Theory of the Photographic Process,* pp. 360 ff, and in U.S. Pat. Nos. 3,476,563; 3,311,476; 3,214,437; 3,737,316; 4,046,573; 3,749,735; 4,296,199; and 4,296,200.

Examples of suitable couplers, in accordance with the present invention, include the following:

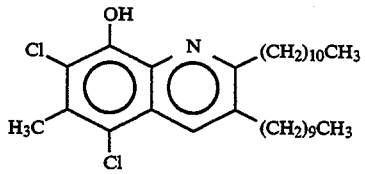

(Structure 1)

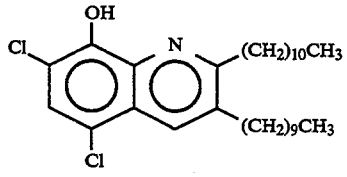

(Structure 2)

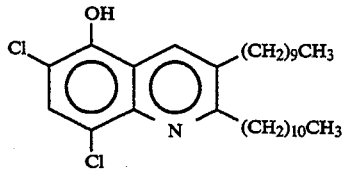

(Structure 3)

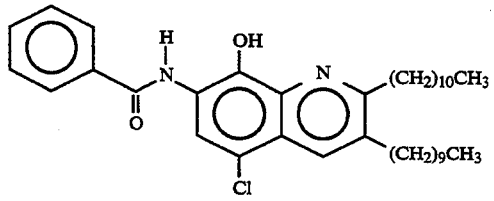

(Structure 4)

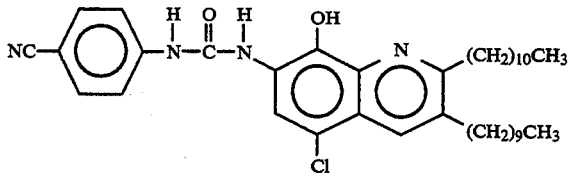

(Structure 5)

-continued

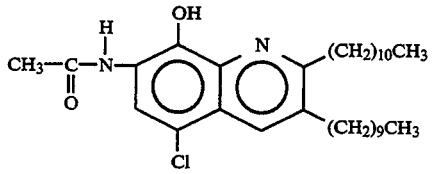

(Structure 6)

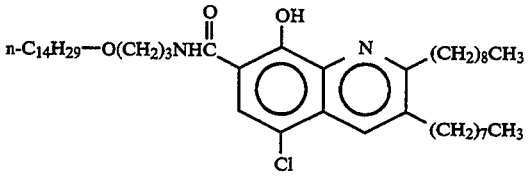

(Structure 7)

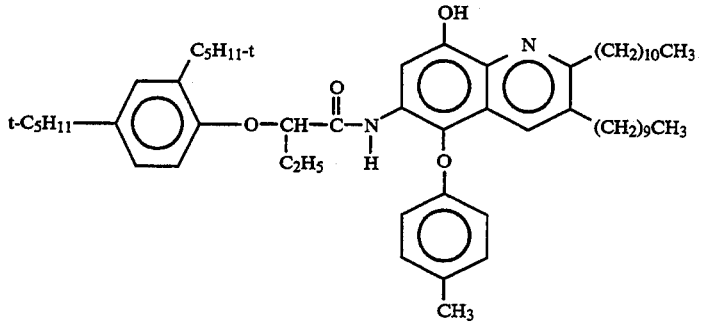

(Structure 8)

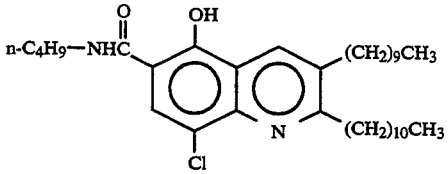

(Structure 9)

In most modern color photographic materials, the coupler compound is incorporated in a layer of the photographic material during manufacture and is rendered immobile in the layer as a result of the bulk provided by one or more ballast groups. As to the present invention, such ballast is furnished by the $R_1$ groups at the 1 and 2 positions. Incorporation of the coupler in the layer is accomplished by dispersing it in a high boiling organic solvent. Use of low boiling auxiliary solvents such as ethyl acetate has become common practice.

The hydroxyquinoline cyan couplers of this invention can be incorporated in silver halide emulsions, and the emulsions can be coated on a support to form a photographic element by techniques well known in the art. U.S. Pat. No. 2,949,360 provides details regarding the use of ethyl acetate as an auxiliary solvent for dispersing the coupler. Alternatively, the coupler can be incorporated in photographic elements adjacent the silver halide emulsion where, during development, the coupler will be in reactive association with development products such as oxidized color developing agent. The coupler can be associated with an image modifying coupler, as described in U.S. Pat. No. 5,021,555 to Szajewski and Taber.

The photographic elements can be either single color or multicolor elements. In a multicolor element, the cyan dye-forming coupler is usually associated with a red-sensitive emulsion, although it could be associated with an unsensitized emulsion or an emulsion sensitized to a different region of the spectrum. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Such an element, in accordance with the present invention, contains a hydroxyquinoline cyan coupler of the present invention. The element can contain additional layers, such as filter layers, interlayers, overcoat layers, subbing layers, and the like.

In the following discussion of suitable materials for use in the elements of this invention, reference will be made to *Research Disclosure*, December 1989, Item 308119, published by Kenneth Mason Publications, Ltd., The Old Harbourmaster's, 8 North Street, Emsworth, Hampshire P010 7DD, ENGLAND. This publication, hereby incorporated by reference, will be identified hereafter by the term "*Research Disclosure.*"

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed in U.S. Pat. Nos. 4,434,226; 4,414,310; 4,399,215; 4,433,048; 4,386,156; 4,504,570; 4,400,463; 4,414,306; 4,435,501; 4,643,966; 4,672,027; and 4,693,964. Also specifically contemplated are those silver bromoiodide grains with a higher molar proportion of iodide in the core of the grain than in the periphery of the grain, such as those described in GB 1,027,146; JA 54/48,521; EP 264,954; and U.S. Pat. Nos. 4,379,837; 4,444,877; 4,665,012; 4,686,178; 4,565,778; 4,728,602; 4,668,614; and 4,636,461. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium, and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in pi Research Disclosure, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure,* cited above, Section IV.

Suitable vehicles for the emulsion layers and other layers of elements of the invention are described in *Research Disclosure,* Section IX and the publications cited therein.

In addition to the cyan couplers described herein the elements of this invention can include additional cyan couplers as described in *Research Disclosure,* Section VII, paragraphs D, E, F and G and the publications cited therein. These additional couplers can be incorporated as described in *Research Disclosure,* Section VII, paragraph C and the publications cited therein.

The photographic elements of this invention can contain brighteners (*Research Disclosure* Section V), antifoggants and stabilizers (*Research Disclosure* Section VI), antistain agents and image dye stabilizers (*Research Disclosure* Section VII, paragraphs I and J), light absorbing and scattering materials (*Research Disclosure* Section VIII), hardeners (*Research Disclosure* Section X), coating aids (*Research Disclosure* Section XI), plasticizers and lubricants (*Research Disclosure* Section XII), antistatic agents (*Research Disclosure* Section XIII), matting agents (*Research Disclosure* Section XVI), and development modifiers (*Research Disclosure* Section XXI).

The photographic elements can be coated on a variety of supports as described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N—(methanesulfonamido)-ethylaniline sulfate hydrate, 4-amino-3-methyl-N-ethyl-N—hydroxyethylaniline sulfate, 4-amino-3—(methanesulfonamido)ethyl-N,N-diethylaniline hydrochloride and 4-amino-N-ethyl-N-2-methoxy-ethyl)-m-toluidine di-p-toluenesulfonic acid.

With negative working halides this processing step leads to a negative image. To obtain a positive (or reversal) image, this step can be preceded by development with a non-chromogenic developing agent to develop exposed silver halide, but not form dye, and the uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The 8- and 5hydroxyquinoline cyan couplers and other 6- and 7-hydroxyquinoline compounds are prepared by the reaction of a substituted aminophenol salt with two molar equivalents of an enolizable aldehyde containing at least one α-substituted hydrogen atoms as follows:

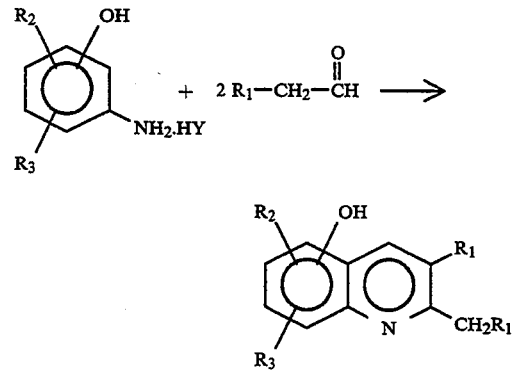

, wherein $R_1$ is a substituted or unsubstituted alkyl group with one to 30 carbon atoms;

$R_2$ and $R_3$ is hydrogen or other substituents; and

HY is a strong organic or inorganic acid

The aldehyde is enolizable to the following structure:

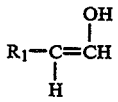

The process of the present invention is carried out under very mild reaction conditions, at temperatures from about 15° C. to about 30° C., preferably 23° C., and in the presence of a solvent, such as methanol or ethanol. The desired hydroxyquinoline compounds generally separate either as salts or as free bases from the reaction mixture and are readily isolated in good yields.

In this process, any aminophenol having an unsubstituted position ortho to the amino group can be used. Examples of useful aminophenols are 2-hydroxyquinoline; 2-hydroxy-5-chloroaniline; 2-hydroxy-3,5dichloroaniline; 2-hydroxy-3,5-dichloro-4-ethylaniline; 2-hydroxy-4alkylamido-5-chloroaniline, where the alkyl group is substituted or unsubstituted; 2-hydroxy-4-arylamido-5-aryloxyaniline, where the aryl groups are phenyl or substituted phenyl; 2-hydroxy-3-carbamylaniline, where the carbamyl group is substituted or unsubstituted; 2-hydroxy-3-ureido-5-fluoroaniline, where the ureido group is substituted or unsubstituted; 3-hydroxy-6-chloroaniline; 3-hydroxy-4-arylamidoaniline; where the aryl group is phenyl or substituted phenyl; 3-hydroxy-4-arylamido-6-chloroaniline, where the aryl group is phenyl or substituted phenyl; 3-hydroxy-4-alkylamido-6-aryloxyaniline, where the alkyl group is substituted or unsubstituted and the aryl group is phenyl or substituted phenyl; 4-hydroxy-3,5-dichloroaniline; 4-hydroxy-2-methylaniline; and 4-hydroxy-3-cyanoaniline. These aminophenols are typically used in the process of the present invention as their salts, formed with strong acids, organic or inorganic, such as hydrochloric, sulfuric, and p-toluenesulfonic acids.

The process of the present invention can utilize any alkyl or substituted alkyl aldehyde containing at least one $\alpha$-substituted hydrogen atoms. The aldehyde can contain from 2 to about 30 carbon atoms. Particularly useful aldehydes for the process of the invention are acetaldehyde, propionaldehyde, t-butylacetaldehyde, phenylacetaldehyde, octylaldehyde, decylaldehyde, dodecylaldehyde, and octadecylaldehyde.

The process of the invention is carried out in a solvent, preferably a polar one in which the salt of the aminophenol is soluble. Examples of useful solvents are methanol, ethanol, ethylene glycol, acetonitrile, acetic acid, dimethylformamide, and mixtures thereof. Once the reaction is complete, the hydroxyquinoline product can be recovered from the liquid as a solid precipitate.

The process of the present invention is advantageous because it is carried out at low temperatures without oxidants or large amounts of strong acids. Further, it can be used to incorporate ballast of any selected size at the 1 and 2 positions of the hydroxyquinoline. Such versatility is advantageous, because it eliminates additional synthetic steps in the attachment of ballast groups to the coupler compound.

Aside from the compounds previously identified as Structures 1–9, the process of the present invention can be utilized to produce compounds of the following formulae:

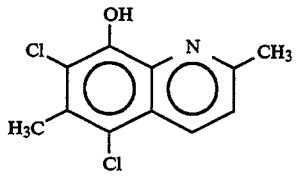

(Structure 10)

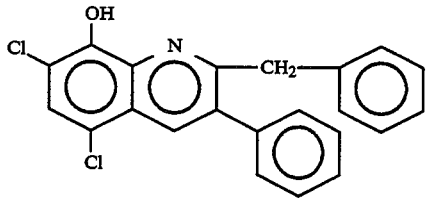

(Structure 11)

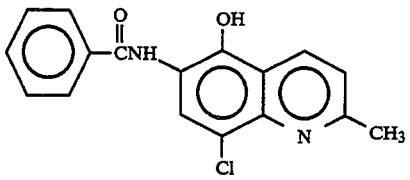

(Structure 12)

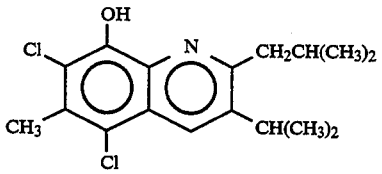

(Structure 13)

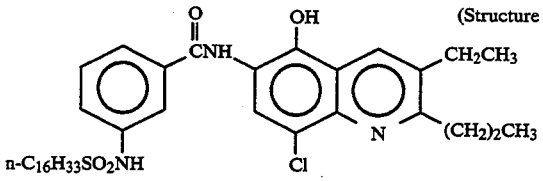

(Structure 14)

EXAMPLES

The following examples further illustrate the invention:

EXAMPLE 1

Preparation of 2-undecyl-3-decyl-5,7-dichloro-8-hydroxyquinoline (Structure 2)

To a stirred suspension of 21.5 g (0.10 mole) of 2-amino-4,6-dichlorophenol hydrochloride in 250 ml of ethanol was added 36.9 g (0.20 mole) of dodecyl aldehyde. The resulting mixture was stirred at room temperature for 2 hours, during which time all the solid dissolved. The mixture was filtered and refrigerated overnight. The white solid that crystallized from solution was collected and dried to give 31 g (61%) of product, m.p. 46°–47° C. The $H^1$NMR spectrum of the product was consistent with the expected structure. Analysis: Calculated for $C_{30}H_{47}C_{12}NO$: C, 70.85; H, 9.31; Cl, 13.94; N, 2.75. Found: C, 70.77; H, 9.15; Cl, 14.03; N, 2.68.

EXAMPLE 2

Preparation of
2-undecyl-3-decyl-5,7-dichloro-6-methyl-8-hydroxyquinoline (Structure 1)

The procedure of Example 1 was repeated except that the starting aminophenol salt was 2-amino-4,6-dichloro-5-methylphenol hydrochloride. A 65% yield of white crystalline needles, m.p. 54.5°-56° C., was obtained. The $H^1$NMR spectrum of the product was consistent with the expected structure. Analysis: Calculated for $C_{31}H_{49}C_{12}NO$: C, 71.28; H, 9.38; Cl, 13.59; N, 2.68. Found: C, 70.85; H, 9.21; Cl, 14.01; N, 2.61.

EXAMPLE 3

Preparation of
2,6-dimethyl-5,7-dichloro-8-hydroxyquinoline (Structure 10)

The procedure of Example 1 was repeated except that the starting aminophenol salt was 2-amino-4,6-dichloro-5-methylphenol hydrochloride and the starting aldehyde was acetaldehyde. The light brown crystalline product, m.p. 234°-236° C., that separated was the hydrochloride salt of the desired hydroxyquinoline compound; the yield was 57%. The free hydroxyquinoline, which was obtained by treating a methanol solution of the salt with an aqueous solution of sodium bicarbonate, was recrystallized from ethanol to give brown needles, m.p. 118°-119° C. Analysis: Calculated for $C_{11}H_9C_{12}NO$: C, 54.57; H, 3.75; Cl, 29.29; N, 5.79. Found: C, 54.49; H, 3.74; Cl, 29.10; N, 5.79.

EXAMPLE 4

Preparation of
2-methyl-6-benzamido-8-chloro-5-hydroxyquinoline (Structure 12)

To a solution of 43.3 g (0.10 mole) of 3-amino-4-chloro-6-benzamidophenol p-toluenesulfonic acid salt in 500 ml of ethanol was slowly added, with stirring, 17.6 g (0.40 mole) of acetaldehyde. The mixture was stirred at room temperature for 8 hours; the yellow solid that precipitated during this time was collected by filtration, washed with ethanol, and dried. The yield of product, which was the p-toluenesulfonic acid salt of the desired hydroxyquinoline compound, was 21 g (67%); its m.p. was 184°-185° (dec.). The free hydroxyquinoline, which was obtained by treating a methanol solution of the salt with an aqueous solution of sodium bicarbonate, was recrystallized from ethanol to give white needles, m.p. 189°-191° C. Analysis: Calculated for $C_{17}H_{13}ClN_2O_2$: C, 65.4; H, 4.2; Cl, 11.3; N, 9.0. Found: C, 65.5; H, 4.5; Cl, 10.9; N, 8.9.

EXAMPLE 5

Preparation of
2-undecyl-3-decyl-5-chloro-7-acetamido-8-hydroxyquinoline (Structure 6)

A solution of 11.5 g (0.050 mole) of 2-nitro-4-chloro-6-acetamidophenol in 150 ml of ethanol containing a small amount of 10% Pd-charcoal catalyst was reduced under hydrogen at 40 psi. After reduction was complete, the catalyst was removed by filtration. To the filtration was added, with stirring, 4.4 ml (0.05 mole) of concentrated hydrochloric acid, followed by 18.4 g (0.10 mole) of dodecyl aldehyde. The mixture was stirred at room temperature for 3 hours, then poured into water. The brown-colored gum that precipitated was dissolved in dichloromethane and chromotographed on a silica gel column. The fractions containing the product were combined, and the solvent was removed to give 12 g (45%) of a white solid, m.p. 120°-121° C. The $H^1$NMR spectrum of this solid was consistent with the expected structure. Analysis: Calculated for $C_{32}H_{51}ClN_2O_2$: C, 72.35; H, 9.68; Cl, 6.67; N, 5.27. Found: C, 72.25; H, 9.50; Cl, 6.65; N, 5.21.

EXAMPLE 6

Preparation of
2-undecyl-3-decyl-5-chloro-7-benzamido-8-hydroxyquinoline (Structure 4)

The procedure of Example 5 was repeated except tat the starting nitro compound in the reduction step was 2-nitro-4-chloro-6-benzamidophenol. The crude product obtained by pouring the reaction mixture into water was purified by chromatography on a silica gel column to give 52% of a white amorphous solid. The $H^1$NMR spectrum of this solid was consistent with the expected structure. Analysis: Calculated for $C_{37}H_{53}ClN_2O_2$: C, 74.91; H, 9.0; N, 4.72. Found: C, 75.01; H, 8.61; N, 4.30.

EXAMPLE 7

Preparation of
2-propyl-3-ethyl-6-(3-hexadecanesulfonamidobenzamido)-8-chloro-5-hydroxyquinoline (Structure 14)

The reaction of 3-amino-4-chloro-6-(3-hexadecanesulfonamidobenzamido)phenol and propionaldehyde was carried out as in Example 1 except that the reaction mixture was poured into water. The gum that precipitated was purified by chromatography on a silica gel column. The yield of product was 40%. The $H^1$NMR of this product was consistent with the expected structure. Analysis: Calculated for $C_{37}H_{54}ClN_3O_4S$: C, 66.14; H, 8.11; N, 6.26. Found: C, 66.37; H, 8.22; N, 6.61.

PHOTOGRAPHIC EXAMPLES

Dispersions of the couplers of the present invention were prepared in the following manner: In one vessel, the coupler, dibutyl phthalate, and ethyl acetate were combined and warmed to form a solution. In a second vessel, 17.6 g of 12.5% gelatin, 2.22 g of Alkanol XC® (E.I. DuPont de Nemours Co., Wilmington, Del.), and water were combined and warmed to about 40° C. The two mixtures were combined and passed three times through a colloid mill. The ethyl acetate was removed by evaporation and water was added to restore the mixture to the weight before evaporation.

EXAMPLE 8

Photographic Dispersion of
2-undecyl-3-decyl-5,7-dichloro-6-methyl-8-hydroxyquinoline (Structure 1)

A dispersion was prepared by the procedure described above from 1.24 g of the 2-undecyl-3-decyl-5,7-dichloro-6-methyl-8-hydroxyquinoline of Example 2, 1.24 g of dibutyl phthalate, 3.72 g of ethyl acetate, and 10.82 g of water.

EXAMPLE 9

Photographic Dispersion of 2-undecyl-3-decyl-5,7-dichloro-8-hydroxyquinoline (Structure 2)

A dispersion was prepared by the procedure described above from 1.20 g of 2-undecyl-3-decyl-5,7-dichloro-8-hydroxyquinoline of Example 1, 1.20 g of dibutyl phthalate, 3.61 g of ethyl acetate, and 11.00 g of water.

EXAMPLE 10

Photographic Dispersion of 2-undecyl-3-decyl-5-chloro-6-benzamido-8-hydroxyquinoline (Structure 4)

A dispersion was prepared by the procedure described above from 1.41 g of 2-undecyl-3-decyl-5-chloro-6-benzamido-8-hydroxyquinoline of Example 6, 1.41 g of dibutyl phthalate, 4.22 g of ethyl acetate, and 10.00 g of water.

EXAMPLE 11

Photographic Dispersion of 2-propyl-3-ethyl-6-(3-hexadecanesulfonamidobenzamido)-8-chloro-5-hydroxyquinoline (Structure 8)

A dispersion was prepared by the procedure described above from 1.59 g of 2-propyl-3-ethyl-6-(3-hexadecanesulfonamidobenzamido)-8-chloro-5-hydroxyquinoline of Example 7, 1.59 g of dibutyl phthalate, 4.77 g of ethyl acetate, and 9.07 g of water.

EXAMPLE 12

Evaluation of Elements Containing Photographic Dispersions

Photographic elements containing dispersions of couplers of the present invention were prepared by coating the following layers in the order listed on a resin-coated paper support. All quantities are in grams per square meter except as noted.

| | |
|---|---|
| 1st Layer | |
| Gelatin | 3.23 |
| 2nd Layer | |
| Gelatin | 1.61 |
| Coupler Dispersion | $4.3 \times 10^{-7}$ mole coupler/$m^2$ |
| Green-sensitized AgCl emulsion | 0.17 mg Ag/$m^2$ |
| 3rd Layer | |
| Gelatin | 1.33 |
| 2-(2H-benzotriazol-2-yl)-4,6-bis-(1,1-dimethylpropyl)phenol | 0.73 |
| Tinuvin 326 (Ciba-Geigy Corp.) | 0.13 |
| 4th Layer | |
| Gelatin | 1.40 |
| Bis(vinylsulfonylmethyl)ether | 0.14 |

The photographic elements were given stepwise exposures to green light and processed as follows at 35° C.

| | |
|---|---|
| Developer | 45 seconds |
| Bleach-Fix | 45 seconds |
| Wash (running water) | 1 minute, 30 seconds |

The developer and bleach-fix were of the following compositions:

| | |
|---|---|
| Developer | |
| Water | 700.00 mL |
| Triethanolamine | 12.41 g |
| Blankophor REU (Mobay Chemical Corp., Pittsburgh, Pa.) | 2.30 g |
| Lithium polystyrene sulfonate | 0.30 g |
| N,N-Diethylhydroxylamine (85% soln.) | 5.40 g |
| Lithium sulfate | 2.70 g |
| N-(2-[(4-amino-3-methylphenyl) ethylamino]ethyl)-methanesulfonamide, sesquisulfate | 5.00 g |
| 1-Hydroxyethyl-1,1-diphosphonic acid (60% soln.) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.04 0.05 | |
| Bleach-Fix | |
| Water | 700.00 mL |
| Solution of ammonium thiosulfate (56.4%) + Ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 6.7 | |

Cyan dyes were formed upon processing. The maximum and minimum densities (D-max and D-min) to green light (Status A) and the wavelength of peak absorption at a density of 1.0 for each coupler are set forth in Table 1.

TABLE 1

| Coupler | Example | D-max | D-min | Absorption maximum (nm) |
|---|---|---|---|---|
| 2-undecyl-3-decyl-5,7-dichloro-6-methyl-8-hydroxyquinoline | 8 | 1.45 | 0.075 | 644 |
| 2-undecyl-3-decyl-5,7-dichloro-8-hydroxyquinoline | 9 | 2.42 | 0.077 | 644 |
| 2-undecyl-3-decyl-5-chloro-6-benzamido-8-hydroxyquinoline | 10 | 2.24 | 0.089 | 671 |
| 2-propyl-3-ethyl-6-(3-hexadecanesulfonamidobenzamido)-8-chloro-5-hydroxyquinoline | 11 | 2.10 | 0.080 | 618 |

Although the invention has been described in detail for the purpose of illustration, it should be understood that such detail is solely for that purpose, and variations can be made therein by these skilled in the art without departing from the spirit and scope of the invention which is defined by the following claims.

What is claimed:

1. In a photographic material comprising:

at least one red-sensitive silver halide emulsion layer with which a cyan dye-forming coupler is associated;

at least one green-sensitive silver halide emulsion layer with which a magenta dye-forming coupler is associated;

at least one blue-sensitive silver halide emulsion layer with which a yellow dye-forming coupler is associated; and a support bearing said at least one red-sensitive, said at least one green-sensitive, and said at least one blue-sensitive silver halide emulsion layers, wherein the improvement comprises said cyan dye-forming coupler having the formulae:

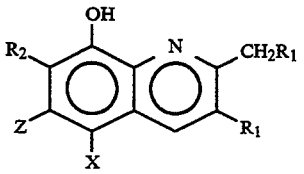

or

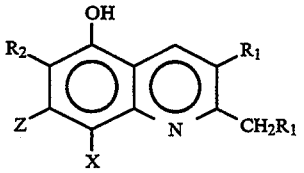

, wherein $R_1$ is a substituted or unsubstituted alkyl group with 8 to 30 carbon atoms;

$R_2$ is hydrogen or another substituent;

X is a group capable of being released by a coupling reaction with an oxidized aromatic primary amine developing agent; and Z is a non-nucleophilic substituent.

2. A photographic material according to claim 1, wherein $R_2$ is selected from the group consisting of hydrogen, a halogen, —$OR_3$, cyano, —$NHCOR_3$, —$NHSO_2R_3$, —$CONHR_3$, and —$NHCONHR_3$, where $R_3$ is a substituted or unsubstituted alkyl group or a substituted or unsubstituted aryl group.

3. A photographic material according to claim 2, wherein Z is selected from the group consisting of hydrogen, —$OR_3$, cyano, —$NHCOR_3$, —$CONHR_3$, and —$NHCONHR_3$, where $R_3$ is a substituted or unsubstituted alkyl group or a substituted or unsubstituted aryl group.

4. A photographic material according to claim 2, wherein Z is selected from the group consisting of hydrogen, —$OR_3$, cyano, —$NHCOR_3$, —$CONHR_3$, and —$NHCONHR_3$, where $R_3$ is a substituted or unsubstituted alkyl group or a substituted or unsubstituted aryl group.

5. A photographic material according to claim 1, wherein said coupler has a formula selected from the group consisting of:

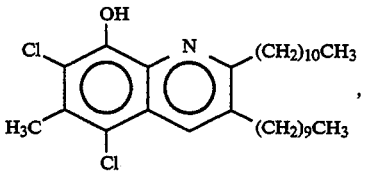

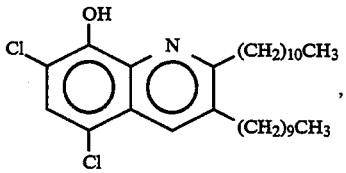

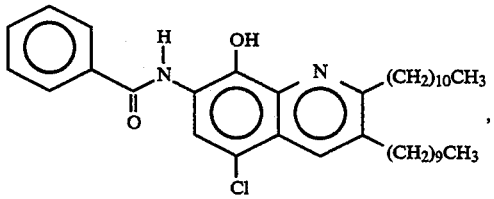

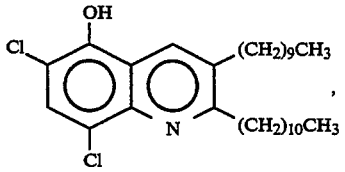

-continued

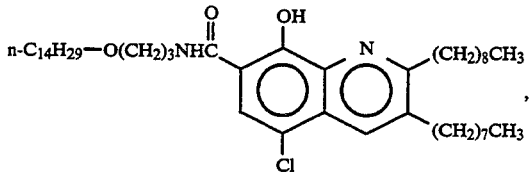

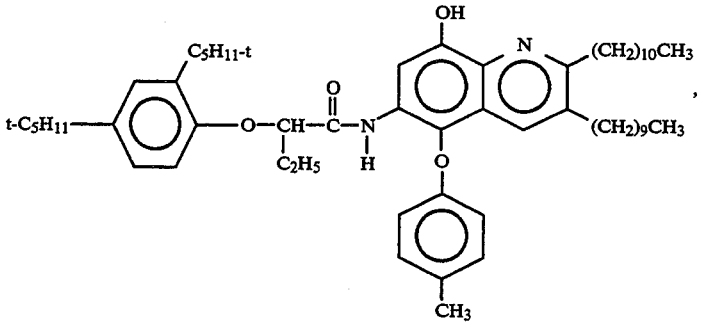

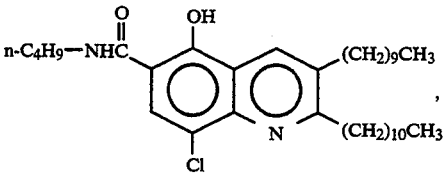

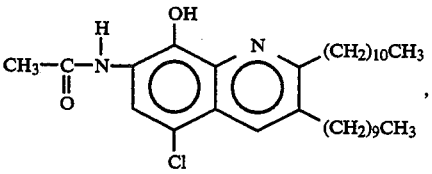

and

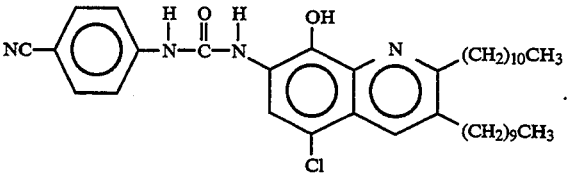

6. A photographic material according to claim 5, wherein said coupler has the formula:

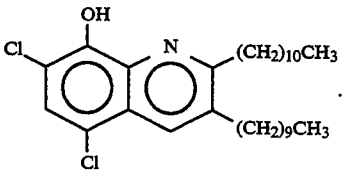

7. A photographic element comprising a support bearing a silver halide emulsion containing a cyan dye-forming coupler having the formulae:

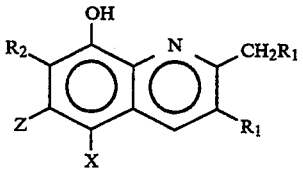

-continued or

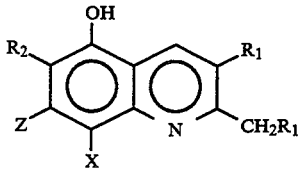

, wherein:

$R_1$ is a substituted or unsubstituted alkyl group with 8 to 30 carbon atoms;

$R_2$ is hydrogen or another substituent;

X is a group capable of being released by a coupling reaction with an oxidized aromatic primary amine developing agent; and Z is a nonnucleophilic substituent.

8. An element according to claim 7, wherein $R_2$ is selected from the group consisting of hydrogen, a halogen, $—OR_3$, cyano, $—NHCOR_3$, $—NHSO_2R_3$, $—CONHR_3$, and $—NHCONHR_3$, where $R_3$ is a substituted or unsubstituted alkyl group or a substituted or unsubstituted aryl group.

9. An element according to claim 8, wherein Z is selected from the group consisting of hydrogen, —$OR_3$, cyano, 'NHCO$R_3$, —CONH$R_3$, and —NHCONH$R_3$, where $R_3$ is a substituted or unsubstituted alkyl group or a substituted or unsubstituted aryl group.

10. An element according to claim 7, wherein Z is selected from the group consisting of hydrogen, a halogen, —$OR_3$, cyano, 'NHCO$R_3$, —CONH$R_3$, and —NHCONH$R_3$, wherein $R_3$ is a substituted or unsubstituted alkyl group or a substituted or unsubstituted aryl group.

11. An element according to claim 7, wherein said coupler has a formula selected from the group consisting of:

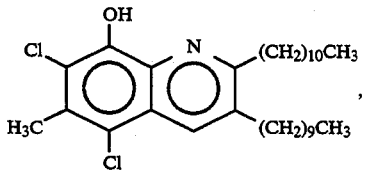

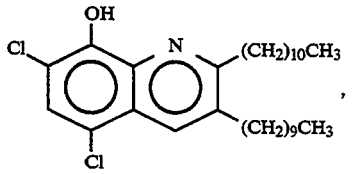

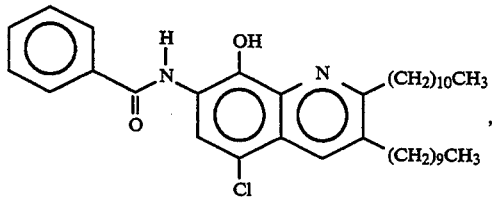

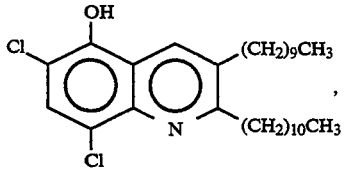

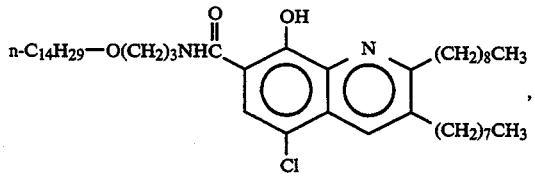

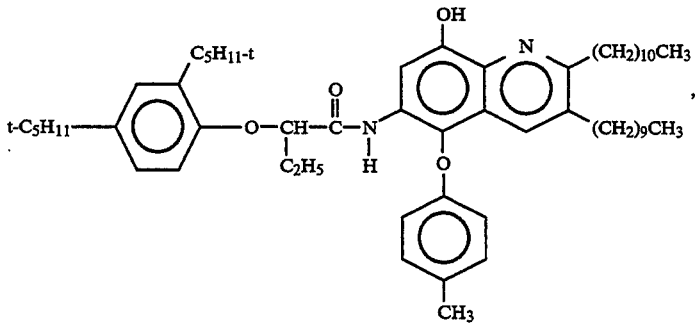

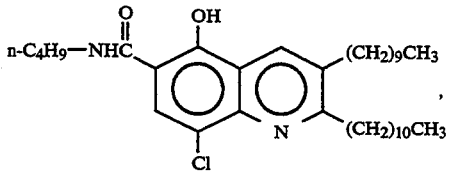

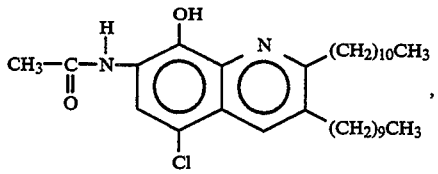
and
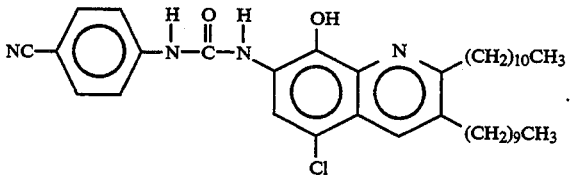
12. An element according to claim 11, wherein said coupler has the formula:
-continued
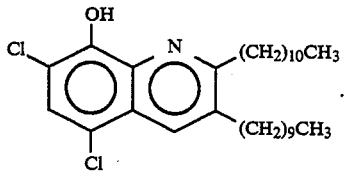
* * * * *